United States Patent [19]

Graf et al.

[11] Patent Number: 4,921,142

[45] Date of Patent: May 1, 1990

[54] MANUALLY OPERABLE FLUID DISPENSER

[75] Inventors: Lothar Graf, Worblingen; Karl-Heinz Fuchs, Radolfzell, both of Fed. Rep. of Germany

[73] Assignee: Ing. Erich Pfeiffer GmbH & Co. KG, Fed. Rep. of Germany

[21] Appl. No.: 903,414

[22] Filed: Sep. 3, 1986

[30] Foreign Application Priority Data

Sep. 14, 1985 [DE] Fed. Rep. of Germany ..... 3532890

[51] Int. Cl.[5] ..... B67D 5/64

[52] U.S. Cl. ..... 222/162; 222/320; 222/386; 239/320; 239/331

[58] Field of Search ..... 222/162, 320, 184, 386, 222/212, 213, 541; 239/320, 331, 309, 329; 604/227, 231, 232; 401/178

[56] References Cited

U.S. PATENT DOCUMENTS

| | | | |
|---|---|---|---|
| 1,670,570 | 5/1928 | Hein | 604/231 |
| 1,926,367 | 9/1933 | Booth | 222/320 |
| 3,014,666 | 12/1961 | Verbouwens | 239/329 X |
| 3,118,573 | 1/1964 | Johnson | 222/212 |
| 3,411,503 | 11/1968 | Santomieri | 222/105 X |
| 3,460,719 | 8/1969 | O'Donnell et al. | 222/320 |
| 3,464,412 | 9/1969 | Schwartz | 222/386 X |
| 3,923,059 | 12/1975 | Ogle | 604/231 X |
| 4,174,790 | 11/1979 | Nozawa et al. | 222/321 |
| 4,175,704 | 11/1979 | Cohen | 239/331 X |
| 4,185,756 | 1/1980 | Sciamonte | 222/562 X |
| 4,308,977 | 1/1982 | Sigmund et al. | 222/320 |
| 4,344,744 | 8/1982 | Schuster et al. | 417/550 |
| 4,349,129 | 9/1982 | Amneus | 222/206 X |
| 4,413,757 | 11/1983 | Adler | 222/212 X |
| 4,664,128 | 5/1987 | Lee | 604/227 X |
| 4,742,940 | 5/1988 | Wilkinson | 222/386 X |

FOREIGN PATENT DOCUMENTS

| | | | |
|---|---|---|---|
| 0021123 | 1/1981 | European Pat. Off. . | |
| 88928 | 9/1983 | European Pat. Off. . | |
| 2143471 | 3/1973 | Fed. Rep. of Germany . | |
| 2461377 | 7/1975 | Fed. Rep. of Germany | 239/329 |
| 2644321 | 4/1978 | Fed. Rep. of Germany | 239/331 |
| 2902624 | 7/1980 | Fed. Rep. of Germany . | |
| 632896 | 10/1927 | France | 222/320 |
| 805024 | 11/1936 | France . | |
| 920943 | 4/1947 | France . | |
| 949453 | 8/1949 | France . | |
| 540339 | 1/1941 | United Kingdom | 239/320 |

*Primary Examiner*—Kevin P. Shaver

*Attorney, Agent, or Firm*—Steele, Gould & Fried

[57] ABSTRACT

A manually operable fluid dispenser is described in which the pump cylinder (12) is a separate part plugged onto a dispenser body (2) and secured against retraction by stop and counter stop members (18, 10). The pump cylinder (12) is engaging a counter member (9) of the dispenser body (2) and this counter member (9) is surrounded at a distance by an additional casing jacket (5) entirely receiving the pump cylinder (12) in the initial position of the pump piston (20). Although a resiliently opening and closing discharge valve is conceivable a discharge closure device can be provided which, upon initially operating the discharge pump, irreversibly opens. An expel member (34) immersed into the hollow pump piston (20) is provided in the pump chamber (14) in such a way that it immerses at the beginning of the pump stroke. The discharge nozzle is provided with a nozzle cap receiving a separate nozzle mandrel and this nozzle mandrel is inserted into a discharge head, thereby engaging directly into a mounting opening of this discharge head.

20 Claims, 1 Drawing Sheet

MANUALLY OPERABLE FLUID DISPENSER

BACKGROUND OF THE INVENTION

The invention relates to a dispenser for a flowable media, particularly an atomizer, with a media reservoir located in a casing and with a thrust piston pump. The pump is provided with a pump piston displaceably guided on a piston path of a pump cylinder between a starting position and a pump stroke end position. The pump includes a pump chamber formed by the pump cylinder and connected to a discharge opening of the dispenser by means of an outlet duct, which is in the form of a dosing chamber determining the discharge volume for each complete pump stroke.

Known dispensers or delivery devices of this type have a media reservoir spatially separated from the pump chamber connected to said pump chamber by means of an inlet duct with an eventually connected intake valve which feeds medium into the pump chamber during the pump piston return stroke. However, this makes such dispensers unsuitable for those applications in which, such as a medical disposable syringe, only a single charge of an, e.g., pharmaceutical, medium is to be delivered and then the discharge device is, instead of being used again, thrown away, e.g. for hygienic, therapeutic or safety reasons.

SUMMARY OF THE INVENTION

The problem of the present invention is to provide a dispenser for flowable media, particularly an atomizer, which is designed in such a way that it is suitable for a single use only, that after use, a minimum amount of residual medium is present therein and which can be manufactured particularly simply in view of the fact that it is only to be used once.

This problem is inventively solved in the case of a dispenser of the aforementioned type in that the complete media reservoir thereof is formed by the closed pump chamber facing the pump piston and that the volume of said media reservoir approximately corresponds to a single discharge volume.

The pump cylinder surrounding the pump chamber is therefore tightly closed, except from the region in which the outlet duct is connected thereto or in which the pump piston is inserted, so that it can be manufactured as a very simple article made from plastic or the like. As the complete medium quantity stored in the dispenser is provided from the outset in the pump chamber or pump cylinder, it can be reliably ensured in a simple manner that the complete stored media quantity is discharged during a single pump stroke.

The inventive construction makes it possible to obviate the need for a cylinder casing with a separate cylinder cover, because the open end of the pump cylinder can be directly covered or closed by the main casing of the dispenser. Thus, as a freely accessible part, the pump cylinder can be directly mounted on the casing, which is, e.g., open at the bottom and otherwise in one part, so that during the pump stroke it can be manually moved out of its starting position and over the pump piston while simultaneously acting as an operating push button. If the latter is in the starting position, i.e., prior to the single use of the dispenser and completely within the casing, i.e. is appropriately set back at least slightly with respect to the open side of the casing, then the cylinder is readily accessible for said operation and also protected against accidental operation or other mechanical stresses. As the closed pump cylinder is only open towards the outlet duct, it does not return to its starting position following operation and instead remains in the pump stroke end position, so that it also forms an indicator by means of which the use state (used or unused) of the dispenser can be clearly recognized. For easier recognition purposes, it is possible to provide a window cutout in the casing surface to make it possible to see the pump cylinder and this appropriately simultaneously constitutes a thumb contact opening for operating the dispenser.

The handle for securing the dispenser against the operating pressure which faces the operating push button is appropriately formed by a finger shield for yielding one-hand operation. This has oppositely projecting finger contact bases on either side adjacent to the central axis of the thrust piston pump, so that the index and middle fingers of the hand can be supported thereon, whilst the thumb rests on the push button. Thus, during operation, the dispenser can be very securely held and accurately guided, which is important when introducing corresponding pharmaceuticals into a nostril. As a result of the described construction, the dispenser can be kept very small, e.g. having a maximum extension of less than 5 cm.

According to a particularly advantageous further development of the invention, the cavities of the dispenser to be filled with or through which pass the medium are appropriately sealed in air-tight manner to the outside and are appropriately filled up to the seal with the medium, i.e. without any air pockets. The seal can be formed by an outlet valve only opening in the case of an over pressure in the pump chamber and which is otherwise tightly closed. One example is a ball hose valve according to DE-OS 29 02 624, corresponding to U.S. Pat. No. 4,344,744 to which reference can be made for further details, particularly with regards to the simple and reliable construction of the valve. However, it is also conceivable to seal in an air-tight manner the outlet duct or discharge opening by means of a seal which does not close again after opening and which is preferably constructed in such a way that on reaching a given overpressure on the side associated with the pump chamber, it opens e.g. accompanied by destruction or cracking. For example a diaphragm could constitute a seal having a desired fracture element or which is held in the closed position by means of at least one desired fracture element.

In order to discharge the entire stored medium, as far as possible during the single pump stroke, a displacement body is appropriately provided in the pump chamber which, in the pump stroke end position, projects well into the outlet duct and preferably approximately up to the seal and keeps it almost completely filled except for the flow slots or cannulas.

BRIEF DESCRIPTION OF THE DRAWINGS

The invention is described in greater detail herein after relative to non-limitative embodiments and the attached drawings that show.

DETAILED DESCRIPTION OF THE PREFERRED EMBODIMENTS

Figure 1:
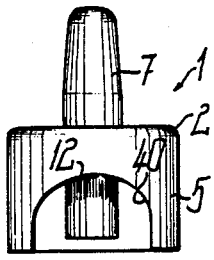
FIG. 1, a dispenser according to the invention in elevation and natural size.
Figure 2:
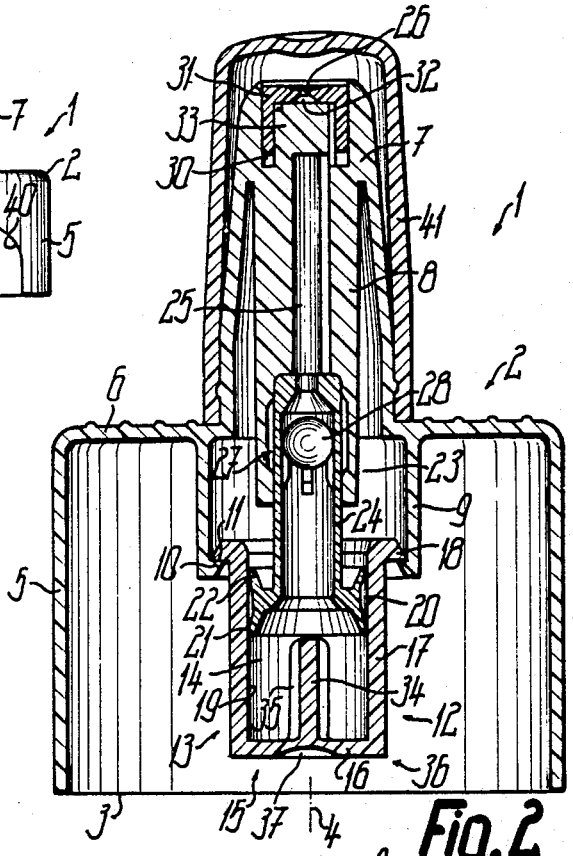
FIG. 2, the dispenser according to FIG. 1 in axial section and on a larger scale.
Figure 3:
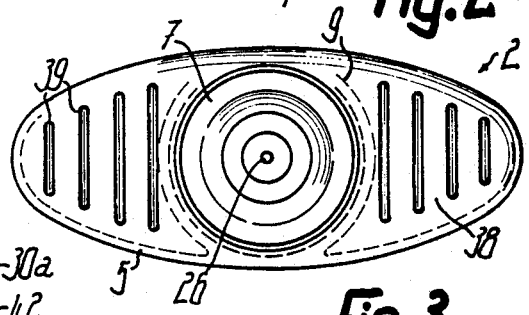
FIG. 3, a plan view of the dispenser according to FIG. 1, but with the cap removed.

The dispenser 1 according to FIGS. 1 to 3 has a casing 2, whose basic body is only open at one side to form a cap with a base 3 located in one plane. Casing 2 is axially symmetrical to a central axis 4 or symmetrical to two axial planes at right angles to one another and to axis 4, but in the direction of one of these axial planes has a much greater length than in the other axial plane. In the represented embodiment, the basic body of casing 2, which is essentially formed by casing surface 5 and end wall 6 opposite the open side, is elliptical in an axial view, so that its outer faces are outwardly convexly curved with different radii of curvature.

A discharge stud 7 projects from the end wall 6 and is made in one piece therewith. The discharge stud 7 is coaxially located with respect to the central axis 4 and, in axial view, is circular. The entire outer circumference of the discharge stud 7 is set back with respect to the outer faces of casing jacket 5, i.e., the discharge stud has an external diameter smaller than the smallest diagonal dimension of the casing cap. The discharge stud 7 is conically tapered by an acute angle towards the free end. The discharge stud 7 is provided with an inner sleeve 8 projecting from the free end of the discharge stud 7 in a contact-free exposed manner over the entire length of inner sleeve 8. The inner sleeve 8 is provided in the form of a sleeve protrusion extending into the basic body of the casing 2 beyond the inner face of the end wall 6.

A substantially cylindrical socket member 9, constructed as one piece with the end wall 6, projects over the inner side thereof. The socket member 9 only projects over part of the height extension or axial length of the basic body of the casing 2. The outer diameter of the socket member 9 can be substantially equal to the smallest external diagonal dimension of the basic body, i.e., the smallest elliptical length of the body. The outer circumference of the socket member 9 passes into a respective cavity formed by the casing jacket 5 in the vicinity of two diametrically opposite zones.

It is also conceivable to form the inner sleeve 9, which defines a socket members, by two approximately semicylindrical shells, whose plane of division located in central axis 4 and is located in the minimum diagonal dimension zone of the casing basic body and which optionally projects in contact-free manner into the casing interior with respect the inner face of casing surface 5. The inner sleeve 9, located on the central axis 4 is provided on its free end with a circular lug or stop cam 10 projecting over its inner circumference which forms a substantially rectangular, circular inner shoulder 11 towards central axis 4. From the end remote from end wall 6, a cylindrical container 12 projects into inner sleeve 9 and which is constructed as a simple, cylindrical, cup-shaped container, which is only open at one end. Cylindrical container 12 forms the complete media reservoir 13 of dispenser 1 and surrounds a pump chamber 14, which is closed at its end opposite to the open end of cylindrical container 12 by a wall which is substantially at right angles to central axis 4. This end face 15 is closed by end wall 16, which is constructed in one piece with the approximately cylindrical surface 17 of cylindrical container 12. At the open end, the surface 17 is provided with an annular, uninterrupted spring-in flange 18 projecting over its outer circumference and which with the inserted cylindrical container 17 engages behind the inner shoulder 11 of inner sleeve 9 and abuts against the same, so that the cylindrical container 12 is accurately axially secured in its starting position.

The inner circumference of cylindrical container 12 or surface 17 forms a piston path 19 for a pump piston 20, which has two oppositely acute-angled converging, axially succeeding piston lips 21, 22 for guiding the piston on piston path 19. Pump piston 20 is constructed as a hollow pump piston, which is provided at the end of a tube portion 24, a piston rod 23 constructed in one piece therewith, the other portion of piston rod 23 being formed by the sleeve shoulder 8. The end of tube portion 24 remote from pump piston 20 is secured in axially abutting manner in a widened bore portion of the associated free end of sleeve shoulder 8. Tube portion 24 and inner sleeve 8 form a discharge duct 25 located within the piston rod 23 in the central axis 4. The discharge duct connects the pump chamber 14 with a discharge opening 26 open to the outside and located at the free end of the discharge stud 7. In the duct connection, an outlet valve 27 is interposed. Outlet valve 27, which is provided in the area of tube portion 24 engaging in sleeve shoulder 8 and approximately in the same axial region as end wall 6, is constructed as a ball valve. The valve body 28 of said outlet valve 27 formed by a ball is tightly surrounded by the associated, elastically expandable longitudinal part of tube portion 24, said longitudinal part being located in the vicinity of a portion of the bore of sleeve shoulder 8 slightly widened with respect to tube's external diameter. Sleeve shoulder 8, on either side of valve body 28, engages on the outer circumference of tube portion 24 and therefore supports the same on either side of valve body 28.

The ball valve 27 is described in greater detail in German Patent DE 2,902,624, corresponding to U.S. Pat. No. 4,344,744 which is cited earlier in the Summary of the Invention.

The surface of a cup-shaped nozzle cap 31 is placed in an annular groove 30 located in central axis 4 on the free end of discharge connection 7 and has, in its free end wall set back slightly with respect to the end face of connection 7, an atomizer nozzle 32 forming discharge opening 26. Annular groove 30 forms a freely projecting mandrel 33, which largely engages on the inner face of the surface of nozzle cap 31, but has connecting channels for the medium leading from the remaining outlet duct 25 to the atomizer nozzle 32.

A displacement body 34, defining an expelling member in the form of a displacement mandrel is provided on the inside of end wall 16 of cylindrical container 12, which is positioned on central axis 4 and projects in the direction counter to pump piston 20. The external diameter of the displacement body is only slightly smaller than the internal diameter of tube portion 24 and which has a plurality of circumferentially distributed longitudinal slots 35 extending over its entire length. In the starting position, the end face of displacement body 34 is approximately located in the plane of the terminal end face of pump piston 20 which faces it. The length of displacement body 34 approximately corresponds to the length of the maximum pump stroke. In the starting position, the pump piston 20 or its rear piston lip 22 is close to the rear end of the piston path 19, which passes into the open end face of cylindrical container 12 via a frustum-widened insertion end portion.

With its end associated with end wall 16, cylindrical container 12 forms, in the manner of a push button, a handle 36, for which purpose is provided in the outside of end wall 16, a spherically segmentally depressed thumb reception surface 37 for reliably supporting the thumb-end of a hand. The outside of end wall 6 of casing 2 forms in each case one handle 38 on either side of discharge connection 7 on the long elliptical legs. This is used for supporting in each case two further fingers of the same hand, so that the handles 36, 38 form a grip for the simultaneous holding and operating of the dispenser 1 by means of a single hand. For better support of the fingers, on the outside of end wall 6 are provided gripping profiles, e.g. in the form of parallel projecting ribs 39. On surface 5 of casing 2 and namely on one of its two wider sides, a cut out 40 is provided symmetrical to the associated axial plane of symmetry of casing 2 and extends with parallel side boundaries up to base 3, whose concavely curved transverse boundary is spaced from end face 6 and at the most approximately extends level with the free end face of inner sleeve 9. The width of the cutout 40 provided for engagement with the thumb is made so large, that the thumb simultaneously is guided on both lateral boundaries, so that casing 2 can be placed on the thumb in a substantially self-holding manner. When using the dispenser, the thumb presses the cylindrical container 12 until its associated end face engages with the inner face of end wall 6 of casing 2 on pump piston 20 and, accompanied by the opening of outlet valve 27 by elastic expansion of the valve support portion of tube portion 24, the medium is discharged in atomized manner through discharge opening 26. Discharge connection 7 is covered by a cap 41 which completely surrounds it and which is secured by means of a spring detent with respect to discharge connection 7 and engages by its free end face on the outer face of end wall 6. Prior to using the dispenser 1, said cap 41 is removed, but is not shown in FIGS. 1 and 3.

Figure 4:
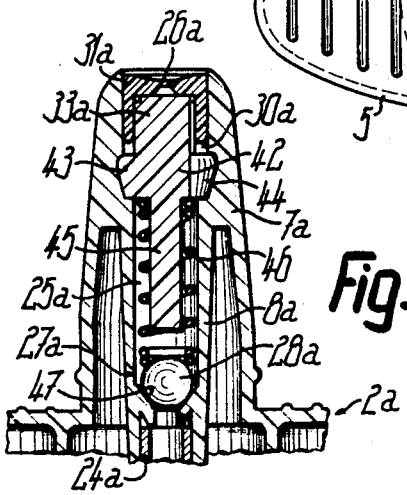
FIG. 4, another embodiment in a detail corresponding to FIG. 2.

In FIG. 4, corresponding parts are given the same reference numerals as in FIG. 2, but are followed by the letter a. In this case, mandrel 33*a* is formed by a separate component 42, which adjacent to the nozzle cap 31*a* is provided with a widened collar 43 which is flattened on one side. Collar 43, which is conically widened in acute-angled manner towards discharge opening 26*a* engages an opening 44 in discharge connection 7*a*, which forms a portion of outlet duct 25*a* which is widened compared with the external diameter of annular groove 30*a* and is adapted to said collar. Accompanied by the elastic expansion of the discharge connection 7*a*, component 42 can be engaged from its free end in opening 44 in such a way that it is axially secured in clearance-free manner and held in centered form. At its end remote from mandrel 33*a*, following into collar 43, component 42 has a guide mandrel 45, whose diameter is significantly smaller than the internal diameter of the associated portion of outlet duct 25*a* and which is surrounded by a valve spring 46 of outlet valve 27*a*. The latter has a valve body 28*a*, formed by a ball. Body 28*a* is movable axially counter to the spring tension of valve spring 46 in the open position. Body 28*a* is associated with a valve seat 47 as an inner shoulder in sleeve flange 8*a*. Thus, unlike the embodiment according to FIGS. 1 to 3, the outlet valve here is not a part of the piston unit and is instead part of the casing 2*a* or discharge connection 7*a*.

For filling the dispensers according to FIGS. 1 to 4, cylindrical container 12 is initially substantially completely filled with the medium to be dispensed, after which the pump piston 20, completely preassembled with casing 2 and outlet valve 27, is introduced into the open end of container 12. Cylindrical container 12 is engaged over the pump piston 20 until outlet valve 27 opens and consequently the enclosed air can escape to the outside. During this operation, the spring-in flange 18 slides with a frustum-shaped widening surface provided on its outer circumference on a corresponding, frustum-shaped counter-surface on the inner circumference of stop cam 18, so that the inner sleeve 9 is widened until flange engages behind inner shoulder 11.

What is claimed is:

1. A manually operable fluid dispenser, comprising:

a thrust piston pump having a pump cylinder and a pump piston displaceably guided in said pump cylinder in a stroke direction over an axial pump stroke between an initial position and a limited end position at the end of the pump stroke, said pump cylinder and a front end of said pump piston defining a pump chamber;

a discharge duct leading from said pump chamber to a discharge nozzle;

a dispenser body bearing said pump piston and said pump cylinder, said dispenser body providing a handle for displacing the pump piston in said pump cylinder, said pump cylinder and an inner sleeve of said dispenser body displaceably engaging with one another, wherein said inner sleeve depends from said handle, a casing jacket depending from an outermost portion of said handle and surrounding said inner sleeve and said pump cylinder, said casing jacket having an open end on one side and said inner sleeve depending from an inside of said casing jacket and having a free end for receiving said pump cylinder, said casing jacket and pump cylinder defining longitudinal extensions along said stroke direction such that in the initial position of said pump piston, said pump cylinder is located within said jacket casing, the jacket casing defining a supporting base permitting the fluid dispenser to be supported by said supporting base on a surface without the cylinder being pressed upwardly by the surface.

2. The dispenser according to claim 1 wherein said inner sleeve and said casing jacket are constructed in one part.

3. The dispenser according to claim 1 wherein said inner sleeve provides a closure means for said pump cylinder.

4. The dispenser according to claim 1, wherein said inner sleeve extends only over a part of said longitudinal extension of said casing jacket.

5. The dispenser according to claim 1 wherein said casing jacket surrounds said inner sleeve in a substantially contact-free manner at a distance, said inner sleeve having a free end projecting into said casing jacket.

6. The dispenser according to claim 1 wherein said inner sleeve has an outer circumference and at least one portion of said circumference passing into the casing jacket.

7. The dispenser according to claim 1 wherein, in an axial view, said casing jacket and a respective end wall are elliptical.

8. The dispenser according to claim 1 wherein said inner sleeve has an outer width substantially equal to a smallest width of the casing jacket.

9. The dispenser according to claim 1, wherein said casing jacket provides said supporting base at the open end.

10. The dispenser according to claim 1 wherein two opposite sides of said casing jacket are spaced further apart than two other opposite sides of said casing jacket, thereby providing two wider casing sides.

11. The dispenser according to claim 10 wherein a thumb sized slot is provided in one of said two wider sides of said casing jacket.

12. The dispenser according to claim 1 wherein said pump cylinder is mounted for non-returning resting in the end position, and an optical indicator being provided for indicating a state of use of the dispenser.

13. The dispenser according to claim 12 wherein said indicator is provided by said pump cylinder and an indicator window in said casing jacket.

14. The dispenser according to claim 13 wherein said indicator window is provided by a thumb sized slot in said casing jacket.

15. The dispenser according to claim 1 wherein said casing jacket forms a cap having an end wall, said end wall having an inside, said inner sleeve projecting from the inside of said end wall, said end wall providing said handle for displacing the pump piston.

16. The dispenser according to claim 15 wherein said casing jacket has a thumb sized slot located at a distance remote from said end wall.

17. The dispenser according to claim 16 wherein said pump cylinder has an axial length, said thumb sized slot extending substantially over the axial length of the pump cylinder.

18. The dispenser according to claim 16 wherein said thumb sized slot has an end boundary located substantially level with the free end of the inner sleeve.

19. A manually operable fluid dispenser, comprising:

a thrust pump having a pump cylinder and a pump piston displaceably guided in said pump cylinder over an axial pump stroke between an initial position and a limited end position at the end of the pump stroke, said pump piston being hollow and said pump cylinder and a front end of said pump piston defining a pump chamber;

a discharge duct leading from said pump chamber to a discharge nozzle;

a dispenser body bearing said pump piston and said pump cylinder, said dispenser body providing a handle for displacing said pump piston in said pump cylinder;

a displacement body in said pump cylinder, said displacement body projecting towards the pump piston, and wherein said displacement body has a plurality of circumferentially distributed longitudinal slots.

20. The dispenser according to claim 19 wherein said longitudinal slots extend over the entire length extension of said displacement body.

* * * * *